US007191763B2

(12) United States Patent
Kashima

(10) Patent No.: US 7,191,763 B2
(45) Date of Patent: Mar. 20, 2007

(54) FUEL SUPPLY APPARATUS FOR FUEL INJECTION ENGINE

(75) Inventor: Kenichi Kashima, Kawasaki (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/218,709

(22) Filed: Sep. 6, 2005

(65) Prior Publication Data

US 2006/0048753 A1 Mar. 9, 2006

(30) Foreign Application Priority Data

Sep. 8, 2004 (JP) ..... 2004-260398

(51) Int. Cl.
*F02M 61/14* (2006.01)

(52) U.S. Cl. ..... 123/468; 123/470

(58) Field of Classification Search ..... 123/467–471, 123/305, 184.21, 195 A
See application file for complete search history.

(56) References Cited

U.S. PATENT DOCUMENTS

| | | | | | |
|---|---|---|---|---|---|
| 4,327,690 | A * | 5/1982 | Sauer et al. | ..... | 123/469 |
| 4,519,371 | A * | 5/1985 | Nagase et al. | ..... | 123/470 |
| 5,465,699 | A * | 11/1995 | Voigt | ..... | 123/470 |
| 5,657,733 | A * | 8/1997 | Dozier et al. | ..... | 123/470 |
| 6,026,774 | A * | 2/2000 | Kajihara et al. | ..... | 123/184.21 |
| 6,148,799 | A * | 11/2000 | Leipelt et al. | ..... | 123/469 |
| 6,223,727 | B1 * | 5/2001 | Tahara et al. | ..... | 123/470 |
| 6,412,450 | B1 * | 7/2002 | Jaasma | ..... | 123/41.31 |
| 6,672,287 | B2 * | 1/2004 | Wada et al. | ..... | 123/468 |
| 6,732,712 | B2 * | 5/2004 | Klotz et al. | ..... | 123/470 |
| 7,028,665 | B2 * | 4/2006 | Taguchi | ..... | 123/336 |

FOREIGN PATENT DOCUMENTS

| | | | |
|---|---|---|---|
| JP | S64-11311 | | 1/1989 |
| JP | H06-264844 | | 9/1994 |
| JP | H07-10463 | | 2/1995 |
| JP | 217661 | * | 8/1997 |
| JP | 2000-8995 | * | 1/2000 |

* cited by examiner

*Primary Examiner*—Hai Huynh
(74) *Attorney, Agent, or Firm*—Global IP Counselors, LLP

(57) ABSTRACT

A fuel supply apparatus is provided for an intake manifold and a fuel injection system that can be easily and reliably mounted together by a mounting structure, even when the intake manifold has an integrated design in which air intake branches curve steeply upward from a downward side to an upstream side. With this fuel supply apparatus, the fuel injection system is mounted with coupling bolts on the top surface of the outer wall of the downstream portion of the intake manifold. The threads of the bolts engage internal threaded bores in the fuel injection system. The heads of the bolts are disposed on a reverse side of a top surface of an outer wall of the intake manifold, with internal threaded bores of the fuel injection system being disposed on a side of the top surface of the outer wall of the intake manifold.

16 Claims, 4 Drawing Sheets

FUEL SUPPLY APPARATUS FOR FUEL INJECTION ENGINE

CROSS-REFERENCE TO RELATED APPLICATIONS

This application claims priority under 35 U.S.C. § 119 to Japanese Patent Application No. 2004-260398. The entire disclosure of Japanese Patent Application No. 2004-260398 is hereby incorporated herein by reference.

BACKGROUND OF THE INVENTION

1. Field of the Invention

The present invention generally relates to a fuel supply apparatus for an internal combustion engine. More specifically, the present invention relates to a fuel supply apparatus in which a fuel injection system of an internal combustion engine is mounted on an intake manifold.

2. Background Information

Fuel injection systems are sometimes mounted to an intake manifold of an internal combustion engine. One example of a mounting structure for a fuel injection system is disclosed in Japanese Laid-Open Patent Application No. 64-011311. The mounting structure of this application is used for mounting a fuel injection system to an intake manifold of a conventional internal combustion engine. The intake manifold is mounted on a cylinder head with a plurality of air intake branches. The air intake branches are curved from a downstream end to an upstream end. The fuel injection valves are mounted on the top surface of the outer wall of the intake manifold near the joining surface of the cylinder head, with the heads of the fuel injection valves inclined toward the curved portions of the intake manifold.

In view of the above, it will be apparent to those skilled in the art from this disclosure that there exists a need for an improved fuel supply apparatus. This invention addresses this need in the art as well as other needs, which will become apparent to those skilled in the art from this disclosure.

SUMMARY OF THE INVENTION

The intake manifold in Japanese Laid-Open Patent Application No. 64-011311 has a compact layout. It has been discovered that the upstream portion of the intake manifold has a collector, which obstructs access to the fuel injection valves. Therefore, the bolts used to install the fuel injection system cannot be tightened with a straight tool from the curved portions of the intake manifold. In other words, the efficiency of the mounting operation of the fuel injection system is reduced.

The present invention was conceived in view of these problems. One object of the present invention is to provide a fuel supply apparatus in which a fuel injection system can be easily and reliably mounted on an intake manifold, especially with an intake manifold having an integrated design in which the air intake branches curves steeply upward.

In order to achieve the object, the present invention provides a fuel supply apparatus for an intake manifold of a fuel injection engine. The fuel supply apparatus comprises a fuel injector, a fuel tube and an intake manifold. The fuel injector is configured to inject fuel. The fuel tube is connected with the fuel injector to supply the fuel injector with the fuel. The intake manifold is configured to direct intake air therethrough in an air flow to a cylinder. The fuel tube is fastened to the intake manifold by a bolt having a head located at a downstream side of the air flow, and a screw part located at an upstream side of the air flow.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
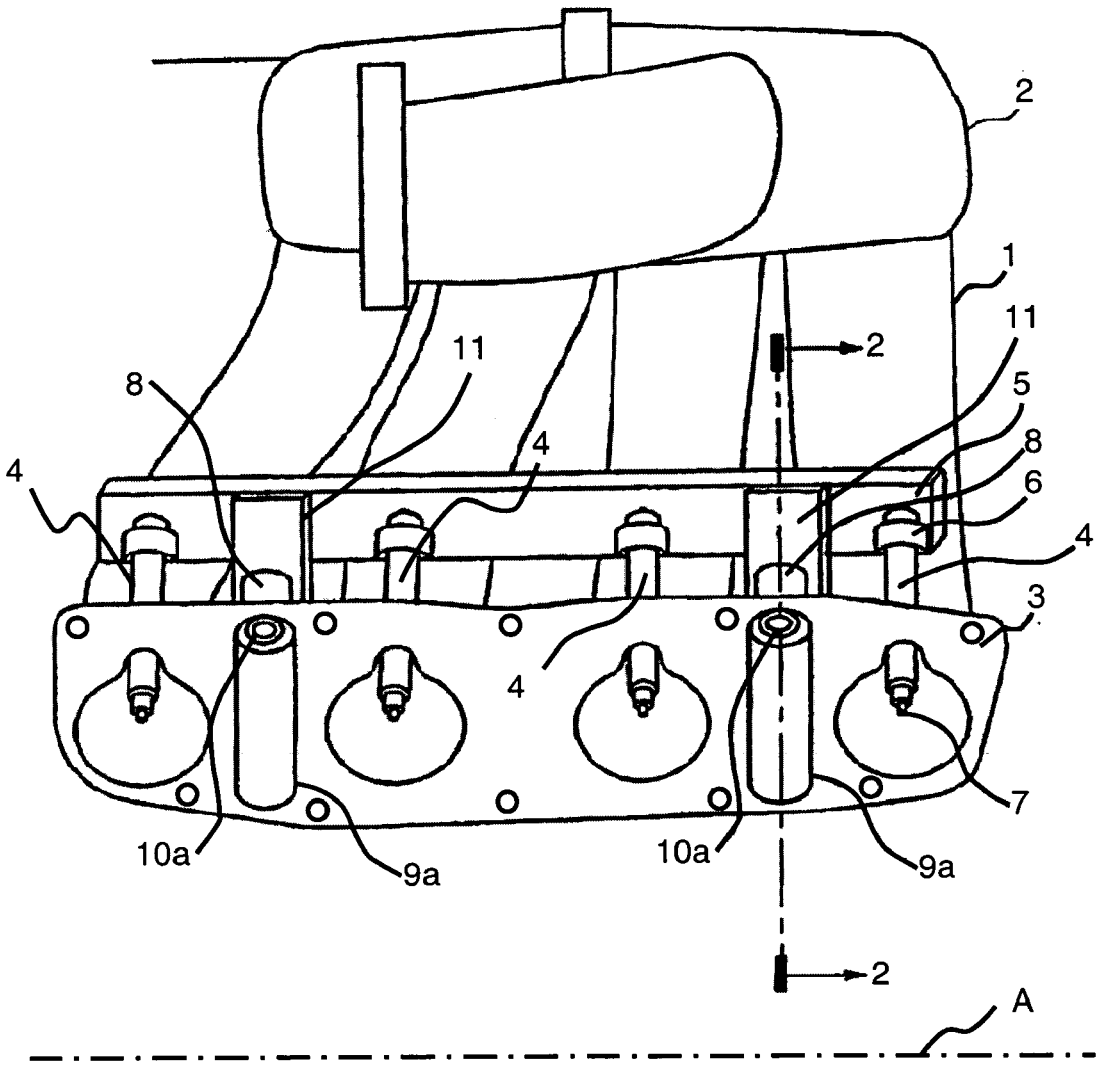
FIG. 1 is a side elevational view of a fuel injection or supply apparatus with a mounting structure for mounting the fuel supply apparatus to an intake manifold of a fuel injection engine in accordance with a first embodiment of the present invention.
Figure 2:
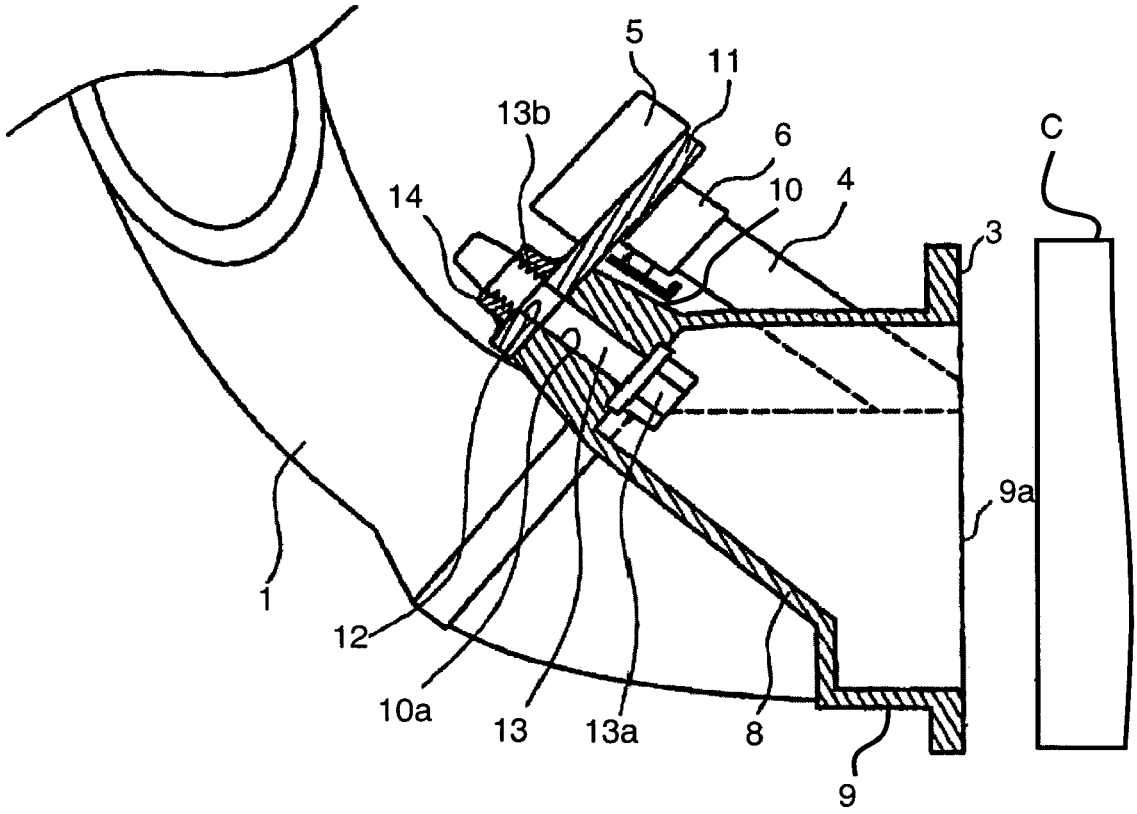
FIG. 2 is a cross-sectional view of the mounting structure of the fuel supply apparatus as seen along section line 2—2 in FIG. 1 in accordance with the first embodiment of the present invention.

Referring initially to FIGS. 1 and 2, a fuel injection or supply apparatus is illustrated in accordance with a first embodiment of the present invention. The fuel supply apparatus basically includes an intake manifold 1 with a collector 2 at an upstream end and a mounting flange or member 3 at a downstream end, a plurality of fuel injection valves or injectors 4 mounted to the downstream end, and a fuel supply tube 5 fluidly connected to the fuel injectors 4. The intake manifold 1 is connected at the downstream end to a side wall of a cylinder head C by a plurality of bolts (not shown). Thus, the intake manifold 1 is configured and arranged to direct intake air to the cylinders of the cylinder head C. The upstream end of the intake manifold 1 has several air intake branches with the upstream sides of the branches connected to the collector 2 and the downstream sides of the branches connected to the intake ports of the cylinders. Preferably, the downstream sides of the air intake branches are curved upward toward the collector 2.

In the illustrated embodiment, the fuel supply apparatus of the present invention includes a fuel injection system that is mounted on the top surface of the outer wall of the intake manifold 1. Thus, the fuel injection system is composed of the fuel supply tube 5 and the fuel injectors 4 that are mounted onto the intake manifold 1. The fuel injection system is configured and arranged near the mounting member 3 of cylinder head C, with the fuel supply tube 5 extending along a direction coinciding with or generally parallel to a crank axis A of a crank shaft (not shown). The fuel injectors 4 are mounted by allowing the nozzle holes at the lower end to pass through the manifold wall, with the heads inclined in an upstream direction of the intake manifold 1. The fuel supply tube 5 is connected to the heads of the fuel injectors 4 by clips 6 to supply the fuel injector 4 with the fuel. Thus, fuel is supplied from the fuel supply tube 5 to the fuel injectors 4, which are configured and arranged to inject fuel through nozzle holes 7 into the intake ports in the cylinder head C. Thus, the intake manifold 1 is configured to direct intake air therethrough in an air flow to a plurality of cylinders with the fuel being injected from the fuel injectors 4 in to the intake air.

As shown in FIG. 1, the mounting structure for coupling the fuel injection system onto the intake manifold 1 includes a pair of box-shaped mounting units 8 with a downstream end 9 and an upstream end 10, a pair of coupling brackets 11 with bolt insertion holes 12, a pair of coupling bolts 13 and a pair of nuts (internal threaded portions) 14. The fuel supply tube 5 is fastened to the intake manifold 1 by the coupling bolts 13 as explained below. More specifically, the coupling brackets 11 of the intake manifold 1 forms a fuel tube fastening member that extends along a direction generally parallel to the crank axis, with the fuel supply tube 5 being fastened to the coupling brackets 11 (the fuel tube fastening member) by the axial forces of the coupling bolts 13. Each of the coupling bolts 13 has a bolt heads 13*a* located at a downstream side of the air flow, and a screw part or screw threads 13*b* located at an upstream side of the air flow. The fuel tube 5 is fastened to the intake manifold 1 by the axial forces of the bolts 13 where the head 13*a* are located at a downstream side of the air flow, and the screw part 13*b* are located at an upstream side of the air flow.

The mounting units 8 are disposed on the mounting member 3 of the cylinder head C, and configured to protrude outward and upward at two locations between adjacent fuel injectors 4 (e.g., between the first and second cylinders and between the third and fourth cylinders). The downstream ends 9 of the mounting units 8 are designed so that a cavity-shaped bolt handling opening 9*a* is formed in each of the mounting units 8. Thus, the surfaces of the mounting units 8 that are joined with the cylinder head C are open. Preferably, the mounting units 8 are integral with the mounting member as a one-piece member. Each of the upstream ends 10 of the mounting units 8 also has a bolt insertion hole 10*a* formed at the end opposite to the bolt handling opening 9*a*. The bolt insertion holes 10*a* are configured to extend through upper distal ends of the mounting units 8. The axes of the bolt insertion holes 10*a* are disposed so as to be substantially parallel to the axes of the fuel injectors 4 as shown in FIG. 2.

The coupling brackets 11 form a fuel tube attachment portion (the fuel tube fastening member). Preferably, the coupling brackets 11 are fixed in place on a bottom surface of the fuel supply tube 5. The coupling brackets 11 are configured to extend downwardly from the fuel supply tube 5 at positions corresponding to the two locations for the mounting units 8. The bolt insertion holes 12 of the coupling brackets 11 are formed on the ends of the coupling brackets 11 that are below the fuel supply tube 5. The bolt insertion holes 12 of the coupling brackets 11 are configured and arranged to receive the coupling bolts 13 to join the fuel supply tube 5 to the end surfaces of the mounting units 8 of the intake manifold 1. Thus, the bolt insertion holes 12 of the coupling brackets 11 are aligned with the bolt insertion holes 10*a* for receiving the coupling bolts 13. The nuts (internal threaded portions) 14 are threadedly engaged with the coupling bolts 13 to secure the coupling brackets 11 to the mounting units 8 of the intake manifold 1. The nuts 14 are fixed in place by welding on the outer sides of the coupling brackets 11 so that the threaded bores or holes of the nuts 14 are aligned with the bolt insertion holes 12. Thus, as a result of providing the coupling brackets 11 with internal threaded portions (nuts 14 with female threads), there is no need to dispose internal threaded portions on the outer wall of the intake manifold 1 as in conventional practice, or to insert metallic internal threaded portions into a resinous collector. Thus, this configuration reduces costs.

When mounting the fuel injection system onto the intake manifold 1, the fuel injectors 4 are first preferably connected to the fuel supply tube 5 via the clips 6 as a unit. Then, the coupling brackets 11 are joined and positioned on the end surfaces of the mounting units 8 of the intake manifold 1, while the distal ends of the fuel injectors 4 are inserted into the injection valve mounting holes in the intake manifold 1.

In this state, the coupling bolts 13 are inserted into the bolt insertion holes 10*a* and 12 via the bolt handling openings 9*a*, and a straight tool is then inserted from the bolt handling openings 9*a* and engaged with the bolt heads 13*a* to ensure axial rotation. Next, the screw threads 13*b* at the distal ends of the coupling bolts 13 are screwed into the nuts 14. The fuel supply tube 5 and the fuel injectors 4 are firmly fastened to the intake manifold 1 via the coupling brackets 11 by the bolt fastening operation at these two locations. The intake manifold 1 on which the fuel injection system is mounted in this manner is joined and fastened to a cylinder head C.

Assuming that the structure is used to mount the fuel injection system on the intake manifold 1 as described above, the coupling bolts 13 can be fastened from the curved outer side of the intake manifold 1 toward the inner side by disposing the heads 13*a* of the coupling bolts 13 on the reverse side of the top surface on the outer wall of the intake manifold 1, and disposing the nuts (internal threaded portions) 14 through which the coupling bolts 13 are screwed to the side of the top surface on the outer wall of the intake manifold 1. The coupling bolts 13 can therefore be easily and reliably fastened using a straight tool without any hindrance from the upstream portion or the collector in an intake manifold with an integrated design having a steeply curving upstream side. In other words, with this arrangement, it is possible to tighten the coupling bolts 13 with a straight tool from the curved outer side of the intake manifold 1 to the inner side, making the operation of mounting the fuel injection system more efficient.

Also, since the axial direction of the bolts is parallel to the axial direction of the fuel injection valves, the fuel injection valves are fastened in the axial direction, and uniform sealing force can be applied to ensure satisfactory sealing without any unnecessary stress.

Figure 3:
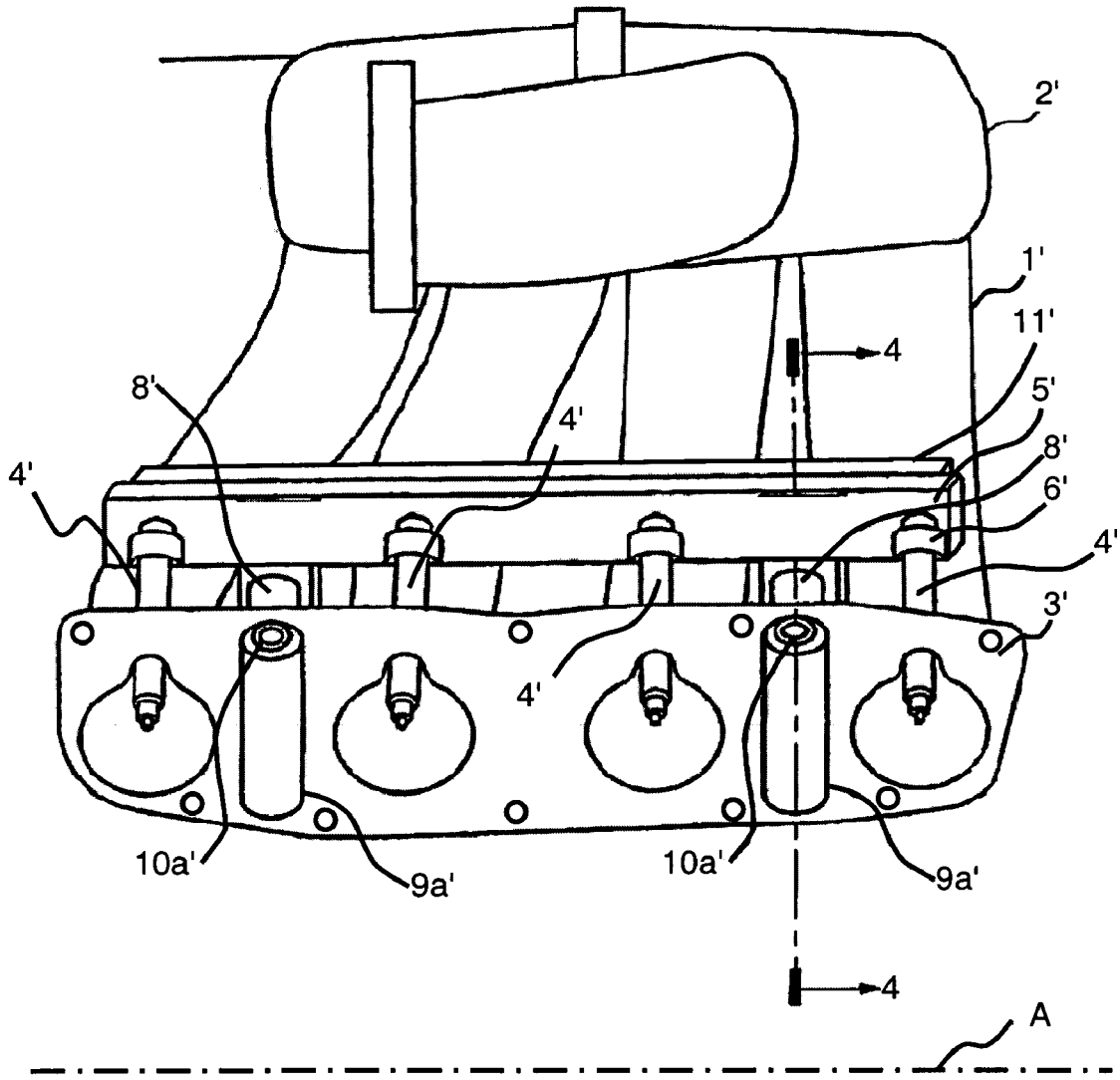
FIG. 3 is a side elevational view of a fuel injection or supply apparatus with a mounting structure for mounting the fuel supply apparatus to an intake manifold of a fuel injection engine in accordance with a second embodiment of the present invention.
Figure 4:
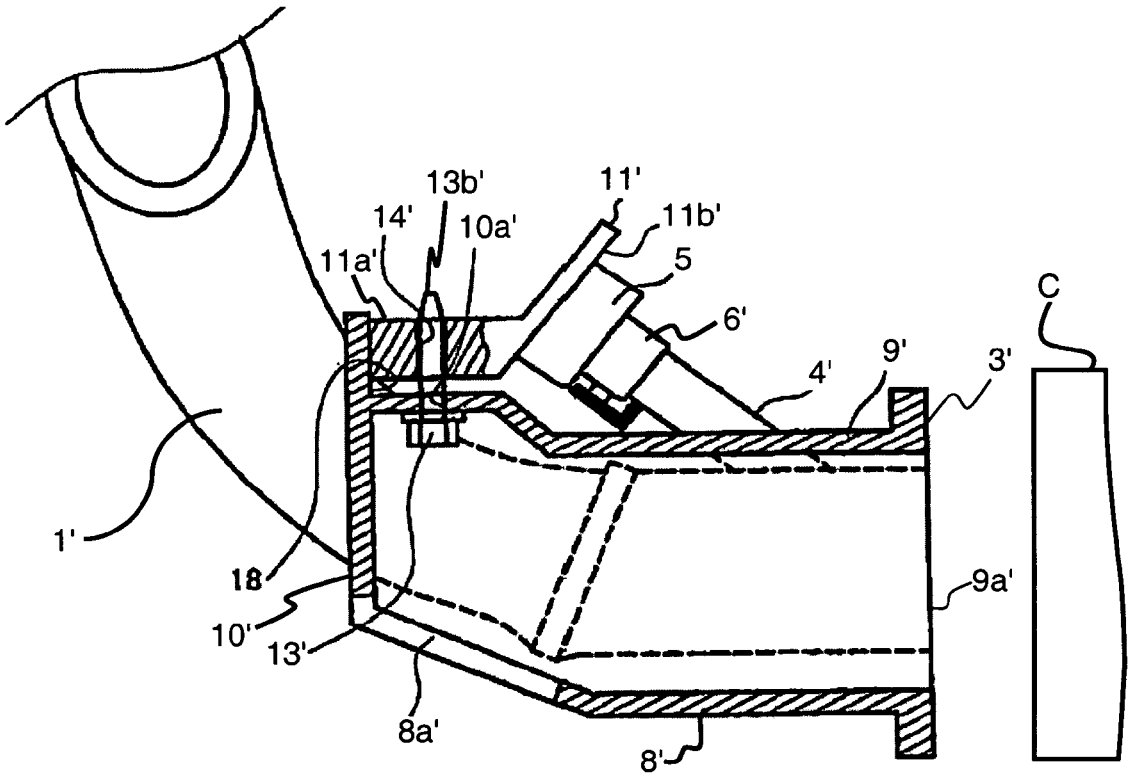
FIG. 4 is a cross-sectional view, similar to FIG. 2, of an alternate mounting structure of an alternate fuel supply apparatus as seen along section line 4—4 in FIG. 3 in accordance with the second embodiment of the present invention.

Referring now to FIGS. 3 and 4, a fuel injection or supply apparatus in accordance with a second embodiment will now be explained. In view of the similarity between the first and second embodiments, the parts of the second embodiment that are substantially identical to the parts of the first embodiment will be given the same reference numerals as the parts of the first embodiment, but with a single prime (') added. Moreover, the descriptions of the parts of the second embodiment that are identical to the parts of the first embodiment may be omitted for the sake of brevity.

As seen in FIG. 3, the fuel supply apparatus of the second embodiment basically includes an intake manifold 1' with the collector 2' at an upstream end and a mounting flange or member 3' at a downstream end, a plurality of fuel injection valves or injectors 4' mounted to the downstream end, and a fuel supply tube 5' fluidly connected to the fuel injectors 4'. As seen in FIG. 4, the intake manifold 1' is connected at the downstream end to a side wall of the cylinder head C by a plurality of bolts (not shown).

The mounting structure for coupling the fuel injection system onto the intake manifold 1' includes a pair of box-shaped mounting units 8' with a downstream end 9' and an upstream end 10', a coupling bracket 11', and a pair of coupling bolts 13' (only one shown). In this embodiment, the coupling bracket 11' has two bolt insertion holes (internal threaded portions) 14' (only one shown in FIG. 4). The mounting units 8' are provided at two locations between adjacent fuel injectors 4', similar to the first embodiment of the intake manifold, but the bolt handling openings 8*a*' are formed in the bottom walls of the mounting units 8', and the bolt insertion holes 10*a*' are formed in the vertical axial direction in the top walls of the mounting units 8' directly above the bolt handling openings 8*a*'. Alternatively, the mounting units 8' can have a U-shaped cross section in which the bottom walls are left open to allow the bolts 13' to be operated. The portions of the top walls of the mounting units 8' are raised perpendicularly upward at locations spaced farther out than the bolt insertion holes 10*a*', and are formed into a guide wall 18 for guiding the coupling bracket 11'. The coupling bracket 11' is disposed above the top walls of these mounting units 8'. The coupling bracket 11' is designed so that internal threaded portions 14', through which the coupling bolts 13' are screwed, are formed in the horizontal bottom walls. Thus, the end surfaces on the outer side (the left side in the diagram in FIG. 4) are abutted against the guide walls 18 of the mounting units 8' and are guided vertically.

The coupling bracket 11' forms a part of the intake manifold 1' that is removable from the intake manifold 1'. The coupling bracket 11' acts as a fuel tube fastening member that extends along a direction coincide with a crank axis A, with the fuel supply tube 5' being fastened to the coupling bracket 11' (fuel tube fastening member) by the axial forces of the coupling bolts 13'. In particular, the coupling bracket 11' includes a pair of mounting portions 11*a*' and an inclined wall 11*b*' extending from the inner side of the bottom wall (the right side in the diagram of FIG. 4 of the mounting portions 11*a*'). These inclined walls 11*b*' are inclined at right angles to the axial direction of the fuel injectors 4' and are joined with the top surface of the fuel supply tube 5'.

In this mounting structure, the coupling bracket 11' is placed above the mounting units 8', with the end surface of the outer sides abut the guide wall 18, and the inclined wall 11*b*' abuts the top surface of the fuel supply tube 5'. In this state, the coupling bolts 13' are inserted into the bolt insertion holes 10*a*' via the bolt handling openings 8*a*'. Then, a straight tool is inserted from the bolt handling openings 8*a*' and engaged with the bolt heads 13*a*' to ensure axial rotation. The threaded portions 13*b*' at the top ends of the bolts 13' are thereby screwed into the internal threaded portions (threaded bores) 14' in the coupling bracket 11'. The coupling bracket 11' is thereby pulled down while the end surfaces of the outer side of the bottom wall are guided by the guide wall 18. As a result of the force of the inclined walls 11*b*' pushing down on the top surface of the fuel supply tube 5', a component of force acts to exert pressure in a direction parallel to the axial direction of the fuel injectors 4', and the fuel injectors 4' are fastened in the same direction together with the fuel supply tube 5'.

As described above, the same effects as in the first embodiment are obtained, and since the bolt handling openings 8*a*' and bolt insertion holes 10*a*' are exposed while the intake manifold 1' is mounted on a cylinder head, the fuel injection system can be removed during maintenance without removing the intake manifold 1' from the cylinder head C.

Also, as in the first embodiment, the mounting operation can be performed more smoothly if the coupling brackets 11' are fixed and integrated by welding or the like to the top surface of the fuel supply tube 5'. In this case, the size of the bolt insertion holes 10*a*' in the mounting units 8' can be increased so that the bolts 13' are allowed to shift during fastening.

As used herein to describe the above embodiment, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A fuel supply apparatus for a fuel injection engine, comprising:

a fuel injector configured to inject fuel;

a fuel tube connected with the fuel injector to supply the fuel injector with the fuel; and an intake manifold configured to direct intake air therethrough in an air flow to a cylinder, the fuel tube being fastened to the intake manifold by a bolt having a head located at a downstream side of the air flow, and a screw part located at an upstream side of the air flow.

2. The fuel supply apparatus according to claim 1, wherein the intake manifold includes a curved portion with the fuel injector being located at an inner curved side of the curved portion of the intake manifold so that the intake manifold partially wraps around the fuel injector.

3. The fuel supply apparatus according to claim 1, wherein the intake manifold includes a fuel tube fastening member extending along a direction generally parallel to a crank axis, with the fuel tube being fastened to the fuel tube fastening member by an axial force of the bolt.

4. The fuel supply apparatus according to claim 1, wherein the intake manifold includes a mating surface configured to mate with a cylinder head, and a shell structure bulging from the mating surface toward the upstream side of the air flow, the mating surface having an opening at a location coinciding with the shell structure; and the fuel tube is fastened to the shell structure with the bolt installed from an inside of the shell structure.

5. The fuel supply apparatus according to claim 1, wherein the fuel tube includes an attachment portion having a female threads in which the bolt is installed.

6. The fuel supply apparatus according to claim 1, wherein the bolt has a longitudinal axis that is parallel to a longitudinal axis of the fuel injector.

7. The fuel supply apparatus according to claim 1, wherein the fuel tube includes a coupling bracket being fastened to the intake manifold with the bolt.

8. The fuel supply apparatus according to claim 1, wherein the intake manifold includes a plurality of separate air intake branches with the bolt being located between the air intake branches as viewed from a side elevational view of the engine.

9. A fuel supply apparatus for a fuel injection engine, comprising:

a fuel injector configured to inject fuel;

a fuel tube connected with the fuel injector to supply the fuel injector with the fuel; and an intake manifold being curved upwardly from downstream portion of the intake manifold towards an upstream portion of the intake manifold; and the fuel tube being fastened to the downstream portion of the intake manifold by a bolt having a head located at a downward side of the intake manifold, and a screw part located at an upward side of the intake manifold.

10. The fuel supply apparatus according to claim 9, wherein the intake manifold includes a fuel tube fastening member extending along a direction generally parallel to a crank axis, with the fuel tube being fastened to the fuel tube fastening member by an axial force of the bolt.

11. The fuel supply apparatus according to claim 10, wherein the fuel tube fastening member has a lower face facing downwardly, with the bolt being upwardly installed on the lower face.

12. The fuel supply apparatus according to claim 9, wherein the intake manifold includes a mating surface configured to mate with a cylinder head, and a shell structure bulging from the mating surface in an opposite direction relative to the cylinder head, the mating surface having an opening at a location coinciding with the shell structure, the shell structure having an inner face facing downwardly to an open space that is in communication with the opening; and the fuel tube is fastened to the shell structure with the bolt installed from an inside of the shell structure.

13. The fuel supply apparatus according to claim 9, wherein the fuel tube includes an attachment portion having female threads in which the bolt is installed.

14. The fuel supply apparatus according to claim 9, wherein the bolt has a longitudinal axis that is parallel to a longitudinal axis of the fuel injector.

15. The fuel supply apparatus according to claim 9, wherein the fuel tube includes a coupling bracket being fastened to the intake manifold with the bolt.

16. The fuel supply apparatus according to claim 9, wherein the intake manifold includes a plurality of separate air intake branches with the bolt being located between the air intake branches as viewed from a side elevational view of the engine.

* * * * *